US005826140A

United States Patent [19]

Zona et al.

[11] Patent Number: 5,826,140

[45] Date of Patent: Oct. 20, 1998

[54] METHOD OF REMANUFACTURING TONER CARTRIDGES

[75] Inventors: Michael F. Zona, Holley; Lucy A. Allchin, Penfield, both of N.Y.

[73] Assignee: Xerox Corporation, Stamford, Conn.

[21] Appl. No.: 829,129

[22] Filed: Mar. 28, 1997

[51] Int. Cl.[6] ..... G03G 15/08

[52] U.S. Cl. ..... 399/106; 156/94; 399/109

[58] Field of Search ..... 399/102, 103, 399/105, 106, 109; 156/94, 322

[56] References Cited

U.S. PATENT DOCUMENTS

| | | | |
|---|---|---|---|
| Re. 35,529 | 6/1997 | Michlin | 399/106 |
| 4,816,877 | 3/1989 | Keen | 355/133 |
| 4,930,684 | 6/1990 | Patterson | 399/262 X |
| 5,223,068 | 6/1993 | Baley | 156/250 |
| 5,370,761 | 12/1994 | Chitouras | 156/94 |
| 5,404,212 | 4/1995 | Ditomaso | 355/260 |
| 5,460,674 | 10/1995 | Chitouras | 156/94 |
| 5,523,828 | 6/1996 | DeKesel | 399/103 |
| 5,525,183 | 6/1996 | Baley | 156/344 |
| 5,531,846 | 7/1996 | Miraglia et al. | 156/64 |

*Primary Examiner*—William J. Royer
*Attorney, Agent, or Firm*—John S. Wagley

[57] ABSTRACT

A seal for sealing a toner filling aperture of a housing of a refilled toner cartridge is provided. The cartridge includes a ruptured closure positioned on the housing adjacent the aperture. The housing and the closure cooperate to define a non-planar surface adjacent the periphery of the aperture. The seal includes a body having a first surface thereof conforming to the periphery of the aperture. The body has an opening therein. The seal also includes a member secured to a second surface of the body. The second surface is opposed to the first surface. The seal also includes an adhesive secured to the first surface of the body. The adhesive conforms to the non-planar surface and seals the body to the closure and the housing so as to permit the cartridge to be sealed without removal of the closure.

26 Claims, 5 Drawing Sheets

METHOD OF REMANUFACTURING TONER CARTRIDGES

The present invention relates to a method and apparatus for remanufacturing toner cartridges. More specifically, the invention relates to resealing refilled toner cartridges.

In the well-known process of electrophotographic printing, the charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In a printer, as the toner within the developer material is transferred to the photoreceptor and eventually to the copy paper, this used toner must be replaced. The printer thus includes a container or cartridge from which fresh toner is dispensed into the machine. To provide for a small, compact cartridge and to provide for a cartridge in which the cartridge may be easily removed, the cartridge typically has a compact shape.

Service costs represent a significant portion of the cost associated with operating a printing machine. Certain components represent those most likely to require service. By providing a method of easily replacing those certain components, the operator may replace those components himself, avoiding service technician labor costs.

These certain components are consolidated within a housing that may be easily replaced by the customer. This housing is typically called a customer replaceable units (CRU). Typically included in a CRU are toner, a cleaning blade, the charging device (a corotron or a bias charge roll), and the photoreceptor.

A CRU is changed several times during the life of a copy machine. While a few of the components within a CRU are consumed during the life of the CRU many of the components may be reused. Therefore, the CRU is now being frequently remanufactured rather than being replaced. The remanufacturing includes refilling the CRU with new toner and inspecting all components that wear. Worn components are replaced.

The CRU must be shipped to the customer in a sealed condition. The customer must break this seal to permit toner to leave the CRU. The broken seal is removed from a used CRU housing during remanufacture. An identical seal is then placed where the original seal was located. Removing the broken seal is very difficult. The adhesive required to secure the original seal is difficult to remove from the housing. This original adhesive must be scraped from the housing, without damaging the housing so that a new housing seal will not leak.

The following disclosures may be relevant to various aspects of the present invention:

U.S. Pat. No. 5,531,846

Patentee: Miraglia et al.

Issue Date: Jul. 2, 1996

U.S. Pat. No. 5,525,183

Patentee: Baley

Issue Date: Jun. 11, 1996

U.S. Pat. No. 5,460,674

Patentee: Chitouras

Issue Date: Oct. 24,1995

U.S. Pat. No. 5,404,212

Patentee: Ditomaso

Issue Date: Apr. 4, 1995

U.S. Pat. No. 5,370,761

Patentee: Chitouras

Issue Date: Dec. 6,1994

U.S. Pat. No. 5,223,068

Patentee: Baley

Issue Date: Jun. 29, 1993

U.S. Pat. No. 4,816,877

Patentee: Keen

Issue Date: Mar. 28, 1989

U.S. Pat. No. 5,531 846 discloses a resealing apparatus for closing the toner dispensing slot of a toner cartridge. The apparatus includes a tool for heating the seal prior to placement over the elongated slot to be sealed. A clamp urges the seal into contact with the cartridge surface surrounding the unsealed opening.

U.S. Pat. No. 5,525,183 discloses a method of resealing a toner cartridge that has a hopper, a mounting member and spacers located therebetween. The method includes the steps of separating the hopper from the mounting member by cutting the spacers and securing a new seal assembly between the hopper and the mounting member to seal the discharge opening.

U.S. Pat. No. 5,460,674 discloses a method of resealing a toner cartridge. The method includes the steps of screening a border of hot melt type adhesive onto a strip of polyester. The polyester seal is installed into the cartridge with the aid of a steel insertion tool. Heating the tool causes the hot melt adhesive to melt and seal the cartridge.

U.S. Pat. No. 5,404,212 discloses a technique for providing an easy to remove leak-proof seal for shipment of a remanufactured toner cartridge. An adhesive-backed sealing strip is disposed over the feed roller of the hopper so that a seal is formed between the Mylar blades and the feed roller. The excess portion of the sealing strip is then passed through a foam feed roller and the lid is then sealed onto the hopper prior to shipment.

U.S. Pat. No. 5,370,761 discloses a method for resealing a toner cartridge. The method includes the steps of removing the original seal, screening a border of hot melt type adhesive onto a strip of polyester. The polyester seal is installed into the cartridge with the aid of a steel insertion tool. Heating the tool causes the hot melt adhesive to melt and seal the cartridge.

U.S. Pat. No. 5,223,068 discloses a reconditioned and resealed toner cartridge. The cartridge includes a toner hopper, an new seal assembly and a mounting member. The new seal assembly includes a gasket and a removable seal member. The new seal is secured between the toner hopper and the mounting member.

U.S. Pat. No. 4,816,877 discloses a method of refilling a toner cartridge. The cartridge has an upper portion with an upper chamber for clean toner and a lower portion with a lower chamber for used toner. The lower portion has a discharge hole opening into the lower chamber. Refilling is accomplished by piercing a hot iron rod into the plastic portion of the upper portion until a refill hole is formed. Toner is then added through this refill hole.

As will be seen from an examination of the prior art, it is desirable to provide an electrostatographic copying system with a toner cartridge having a resealing system that is simple, reliable, and inexpensive. The present invention is directed to overcoming at least some of the aforementioned problems.

SUMMARY OF THE INVENTION

In accordance with one aspect of the present invention, there is provided a seal for sealing a toner filling aperture of a housing of a refilled toner cartridge. The cartridge includes a ruptured closure positioned on the housing adjacent the aperture. The housing and the closure cooperate to define a non-planar surface adjacent the periphery of the aperture. The seal includes a body having a first surface thereof conforming to the periphery of the aperture. The body has an opening therein. The seal also includes a member secured to a second surface of the body. The second surface is opposed to the first surface. The seal also includes an adhesive secured to the first surface of the body. The adhesive conforms to the non-planar surface and seals the body to the closure and the housing so as to permit the cartridge to be sealed without removal of the closure.

In accordance with another aspect of the present invention, there is provided a refilled toner cartridge for use in a printing machine. The cartridge includes a housing having a chamber therein for storing toner and an aperture in communication with the chamber. The cartridge also includes a ruptured closure positioned on the housing adjacent the aperture. The housing and the closure cooperate to define a non-planar surface adjacent the periphery of the aperture. The cartridge also includes a seal for sealing the aperture. The seal includes a body having a first surface thereof conforming to the periphery of the aperture. The body defines an opening therein. The seal also includes a member secured to a second surface of the body. The second surface is opposed to the first surface. The seal also includes an adhesive secured to the first surface of the body. The adhesive conforms to the non-planar surface and seals the body to the closure and the housing so as to permit the cartridge to be sealed without removal of the closure.

In accordance with yet another aspect of the present invention, there is provided an electrophotographic printing machine of the type including a refilled toner cartridge. The toner cartridge includes a housing having a chamber therein for storing toner and an aperture in communication with the chamber. The cartridge also includes a ruptured closure positioned on the housing adjacent the aperture. The housing and the closure cooperate to define a non-planar surface adjacent the periphery of the aperture. The cartridge also includes a seal for sealing the aperture. The seal includes a body having a first surface thereof conforming to the periphery of the aperture. The body defines an opening therein. The seal also includes a member secured to a second surface of the body. The second surface is opposed to the first surface. The seal also includes an adhesive secured to the first surface of the body. The adhesive conforms to the non-planar surface and seals the body to the closure and the housing so as to permit the cartridge to be sealed without removal of the closure.

BRIEF DESCRIPTION OF THE DRAWINGS

The invention will be described in detail herein with reference to the following figures in which like reference numerals denote like elements and wherein.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 5:
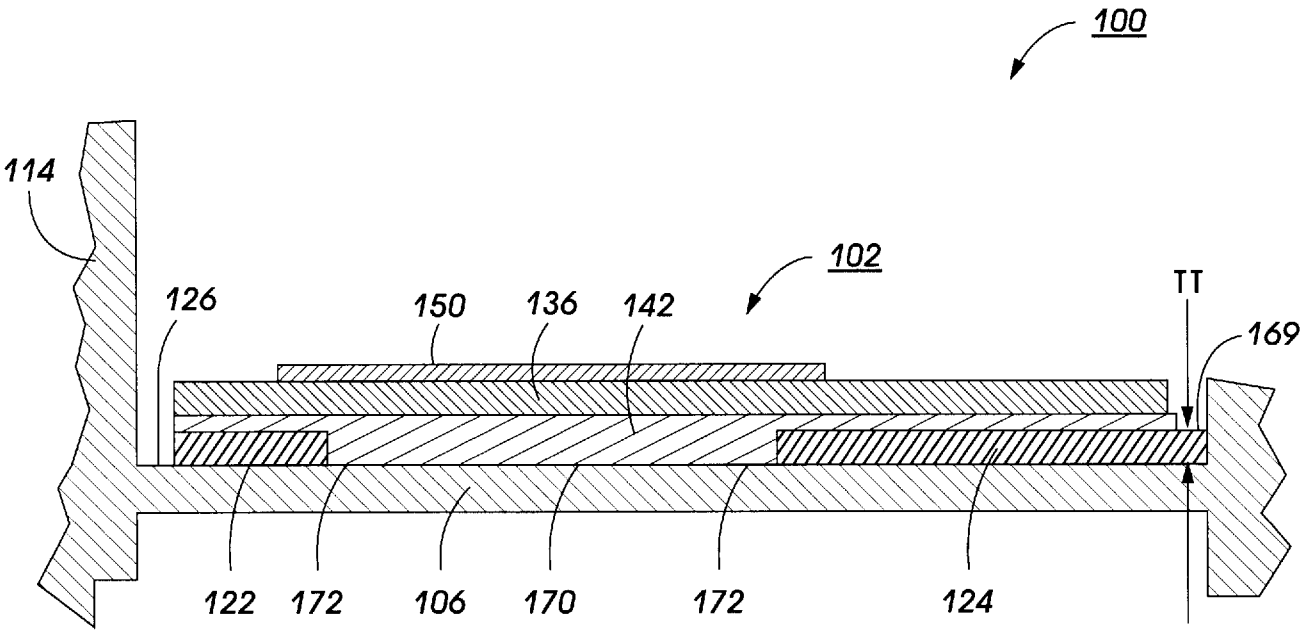
FIG. 5 is a partial plan view along the line 5—5 in the direction of the arrows of the FIG. 1 toner cartridge seal.

For a general understanding of the illustrative electrophotographic printing machine incorporating the features of the present invention therein, reference is made to the drawings. In the drawings, like reference numerals have been used throughout to designate identical elements. FIG. 5 schematically depicts the various components of an electrophotographic printing machine incorporating the integral flexible latch of the present invention therein. Although the integral flexible latch of the present invention is particularly well adapted for use in the illustrative printing machine, it will become evident that the integral flexible latch is equally well suited for use in a wide variety of machines where sliding or pivoting members are secured and are not necessarily limited in their application to the particular embodiments shown herein.

Figure 6:
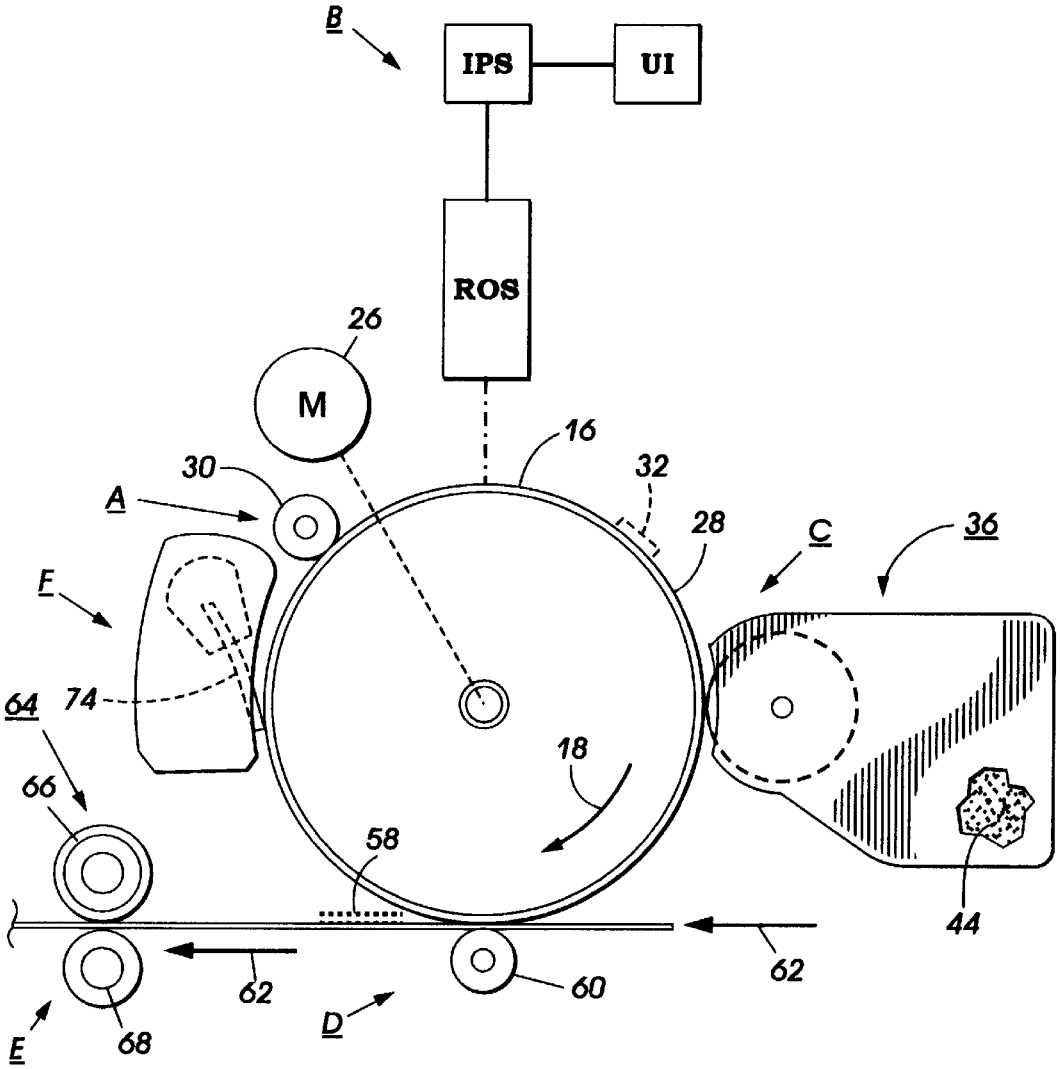
FIG. 6 is a schematic elevational view of an illustrative electrophotographic printing machine incorporating the integral flexible latch of the present invention therein.

Referring now to FIG. 6, the electrophotographic printing machine shown employs a photoconductive drum 16, although photoreceptors in the form of a belt are also known, and may be substituted therefor. The drum 16 has a photoconductive surface deposited on a conductive substrate. Drum 16 moves in the direction of arrow 18 to advance successive portions thereof sequentially through the various processing stations disposed about the path of movement thereof. Motor 26 rotates drum 16 to advance drum 16 in the direction of arrow 18. Drum 16 is coupled to motor 26, by suitable means such as a drive.

Initially successive portions of drum 16 pass through charging station A. At charging station A, a corona generating device, indicated generally by the reference numeral 30, charges the drum 16 to a selectively high uniform electrical potential. The electrical potential is normally opposite in sign to the charge of the toner. Depending on the toner chemical composition, the potential may be positive or negative. Any suitable control, well known in the art, may be employed for controlling the corona generating device 30.

Next, the charged portion of photoconductive surface 12 is advanced through exposure station B. At exposure station B, information that is indicative of the pages to be printed is transmitted to an image processing system (IPS), indicated generally by the reference numeral 30. IPS 30 is the control electronics which prepare and manage the image data flow to raster output scanner (ROS), indicated generally by the reference numeral 34. A user interface (UI), indicated generally by the reference numeral 32, is in communication with the IPS. The UI enables the operator to control the various operator adjustable functions. The output signal from the UI is transmitted to IPS 30. The signal corresponding to the desired image is transmitted from IPS 30 to ROS 34, which creates the output copy image. ROS 34 lays out the image in a series of horizontal scan lines with each line having a specified number of pixels per inch. The ROS includes a laser having a rotating polygon mirror block associated therewith. The ROS exposes the charged photoconductive surface of the printer.

At development station C, a development system or unit, indicated generally by the reference numeral 36 advances developer materials into contact with the electrostatic latent images. The developer unit includes a device to advance developer material into contact with the latent image.

The developer unit 36, in the direction of movement of drum 16 as indicated by arrow 18, develops the charged image areas of the photoconductive surface. This developer unit contains, for example, black developer material 44 having a triboelectric charge such that the black toner is attracted to charged areas of the latent image by the electrostatic field existing between the photoconductive surface and the electrically biased developer rolls in the developer unit, which are connected to the bias power supply 42, attracts the toner to the latent image.

A sheet of support material 58 is moved into contact with the toner image at transfer station D. The sheet of support material 58 is advanced to transfer station D by conventional sheet feeding apparatus, not shown. Preferably, the sheet feeding apparatus includes a feed roll contacting the uppermost sheet of a stack of copy sheets. Feed rolls rotate so as to advance the uppermost sheet from the stack into a chute which directs the advancing sheet of support material into contact with the photoconductive surface of drum 16 in a timed sequence so that the toner powder image developed thereon contacts the advancing sheet of support material at transfer station D.

Transfer station D includes a corona generating device 60 which sprays ions of a suitable polarity onto the backside of sheet 58. This attracts the toner powder image from the drum 16 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a pressure roller 68. Sheet 58 passes between fuser roller 66 and pressure roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator. It will also be understood that other post-fusing operations can be included, for example, binding, inverting and returning the sheet for duplexing and the like.

After the sheet of support material is separated from the photoconductive surface of drum 16, the residual toner particles carried by image and the non-image areas on the photoconductive surface are removed at cleaning station F. The cleaning station F includes a blade 74.

It is believed that the foregoing description is sufficient for purposes of the present application to illustrate the general operation of an electrophotographic printing machine incorporating the development apparatus of the present invention therein.

Figure 1:
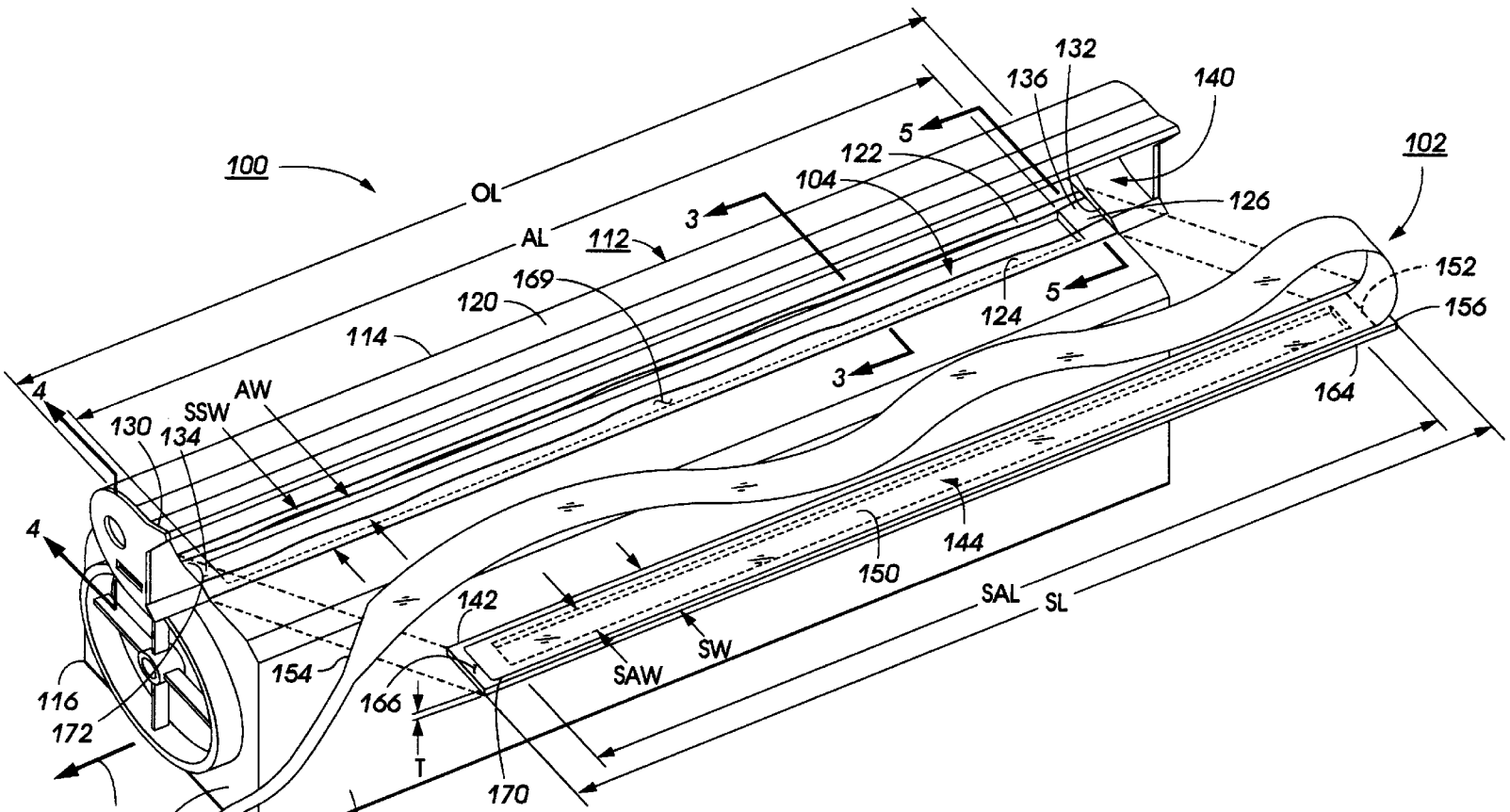
FIG. 1 is a perspective view of an embodiment of the toner cartridge seal of the present invention installed onto a customer replaceable unit of an electrophotographic copy machine.

According to the present invention and referring to FIG. 1, a customer replaceable unit CRU 100 is shown. The CRU 100 is installed in a printing machine. The CRU 100 includes a seal 102 for sealing a toner dispensing aperture 104.

The CRU 100 also, preferably, includes a photoconductor 28 in the form of a photoreceptor drum. The CRU 100 also, preferably, includes a charging device 30 in the form of a bias charge roll as well as cleaning blade 74.

Referring now to FIG. 1, the CRU 100 including the replacement seal assembly 102 according to the present invention, is shown in greater detail. The CRU 100 includes a housing 106 to which the components within the CRU are mounted. The CRU 100 may have any suitable shape. Preferably, the CRU has a space efficient shape which may be easily, removeably mounted into the printing machine. The CRU may be made of any suitable, durable material, for example, a plastic. Such a suitable plastic is polypropylene sheet, commercially available from Mitsu Toatsu Chemical Company.

Extending from first side 110 of the housing 106 is a dome 112. The dome 112 includes a rear portion 114 extending outwardly from the base 116 of the housing 106. The dome 112 further includes a top portion 120 extending forwardly from rear portion 114. The toner dispensing aperture 104 is located under the dome 112.

Since the toner dispensing aperture 104 is located within the dome 112, access to the aperture 104 is limited. The aperture of a new CRU is sealed during shipment by a Tyvek material, available from E.I. duPont and Company. Since access to the original seal is limited by the dome 112, first original seal strip 122 and second original seal strip 124 are permitted to remain on original sealing surface 126 surrounding the aperture 104.

The original sealing surface 126 extends from first side wall 130 of the dome 112 to the second side wall 132. The original sealing surface 126 thus has a length OL and a width SSW. The aperture 104 has a length AL less than length OL of surface 126. The aperture 104 has a width AW which is less than width SSW of surface 126.

Replacement seal assembly 102 is installed onto the CRU 100 and covers the first end portion 134 and the second and portion 136 of the original sealing surface 126 as well as covering the first original seal strip 122 and the second original seal strip 124. The seal assembly 102 is installed through front opening 140 of dome 112.

Replacement seal assembly 102 includes a body 142. The body 142 has any suitable shape capable of sealing the corresponding opening. For example, as shown in FIG. 1, the body 142 has a rectangular shape with a length SL and a width SW. The length SL of the body 142 is slightly smaller than length OL of surface 126 and the width SSW of body 142 is slightly less than width SSW of surface 126.

The body 142 also includes an opening 144 therein. The opening 144 may have any suitable shape, but preferably, for a rectangular body, the opening 144 is likewise rectangular with a length SAL slightly smaller than length SAL of body 142. The opening 144 has a width SAW which is slightly less than width SW of the body 142. The body 142 has a thickness T suitable for providing sufficient strength for body 142.

The body 142 may be made of any suitable durable material. For example the body 142 may be made of a plastic. Polystyrene is particularly well suited for the body 142.

The opening 144 of the body 142 is covered by seal 150. The seal 150 may be made of any suitable, durable material. For example, the seal 150 may be made of a plastic, for example a polymer. Material LTA 79 or LTA 90, available from Matai (USA), Inc., Springfield, Ohio, USA, has been found to be well suited for this application.

The seal may be secured to the body in any suitable manner. For example, the seal may be glued or, as shown in FIG. 1, bonded to the body. Bonding of the seal 150 to the body 142 may be accomplished by heat and pressure. For example by a tool with a temperature of 200 degrees Fahrenheit and a pressure of 50 PSI. A bonding area 152 is formed around the opening 144 with the seal 150 bonded to body 142.

To permit the removal of the seal 150 from the opening 144, a suitable removal method is required. Such a removal method is shown in FIG. 1 in the form pull strip 154. The pull strip 154 may be made of any suitable, durable material. For example the pull strip 154 may made of a plastic. Preferably, as shown in FIG. 1, the pull strip 154 is integral with the seal 150. To permit the easy removal of the seal 150, the pull strip 154 extends from second end 156 of seal assembly 102 to an area outside the CRU 100. By pulling on the end 160 of strap 154 the seal 150 is removed. Second end 156 of seal assembly 102 is first exposed and, as the pull strip 154 is moved in the direction of arrow 162, the pull strip 154 is completely severed from the body 142. The opening 144 is again exposed permitting the toner material within the CRU 100 to be utilized.

The replacement seal assembly may be installed into the CRU 100 in any suitable manner in which the toner dispensing aperture 104 is adequately sealed. For example, as shown in FIG. 1, the body 142 is positioned with lower face 164 of the body 142 overlaying the original surface 126 of housing 106. The lower face 164 of the body 142 is opposed to upper face 166 of body 142. The seal 150 is secured to the body 142 at upper face 166.

The body 142 may be secured to the CRU 100 any suitable manner. Preferably, the lower surface 164 is secured to the first original sealing strip 122, the second original sealing strip 124, the first end portion 134 and the second end portion 136. It should be appreciated that the strips 122 and 124 are on a different plane than the original sealing surface 126. The end portions 134 and 136 are below the surface 169 of the strips 122 and 124.

To secure the body 142 to the CRU 100 and to seal the body 142 to the CRU 100, an adhesive 170 is preferably positioned between the body 142 and the top surface 169 of the original sealing strips 122 and 126 and original sealing surface 126 at end portions 134 and 136. The adhesive 170 is used to fill the gaps 172 between the surface 126 at end portions 134 and 136 and strips 122 and 124

The adhesive 170 is any suitable, durable adhesive capable of sealing the seal assembly 102 to the CRU 100. The adhesive must be made of a composition with a consistency capable of filling the gap 172 between the strips and surface 126. Acrylic resin adhesives with a thickness of approximately 0.13 millimeters to 0.25 millimeters are generally capable of filling such gaps. Adhesive No. 9672 available from 3M Co., Minneapolis, Minn., has been found to be effective in sealing the seal assembly 102 to the CRU 100.

The CRU 100 is adaptable to several currently available copying machines. The CRU 100 may be used in Xerox Corp., Stamford, Conn., model number 4505 and 4510. The CRU 100 may also be utilized in Apple Corporation, Redmund, Wash., Laser Writer model number 310 and 360. The CRU is also adaptable for Pitney Bowes model number 9700, Panasonic model Panafax 755, as well as at least one model of Digital Equipment Corporation (DEC) printers, NEC printers and Star printers.

Figure 2:
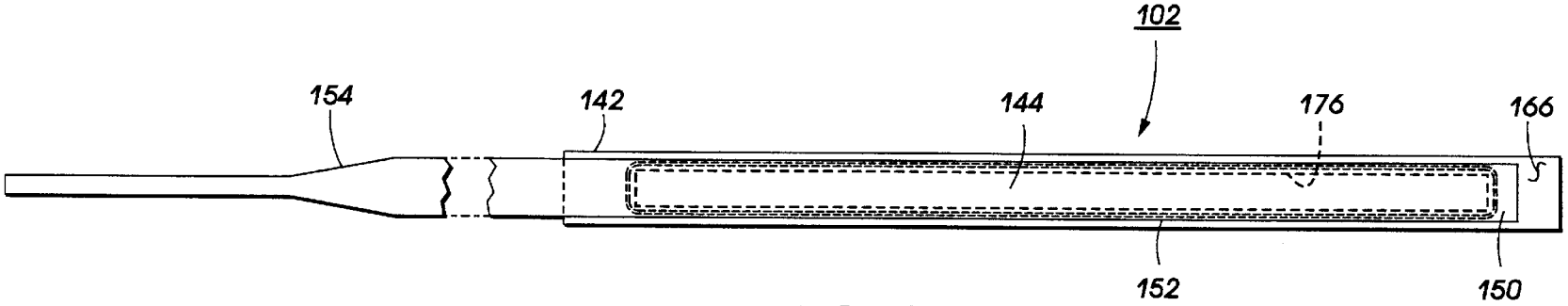
FIG. 2 is a plan view of the toner cartridge seal of FIG. 1.

Referring now to FIG. 2, the seal assembly 102 is shown in greater detail. The body 142 has a generally rectangular shape with a generally rectangular opening 144. The seal 150 is positioned over upper face 66 of the body 142. Bond area 152 is positioned near inner periphery 176 of body 142. The pull strip 154 is preferably integral with seal 150 and extends from one end thereof. The pull strip 154 may be narrowed at its end 160 to assist in the pulling of the strip 154.

Figure 3:
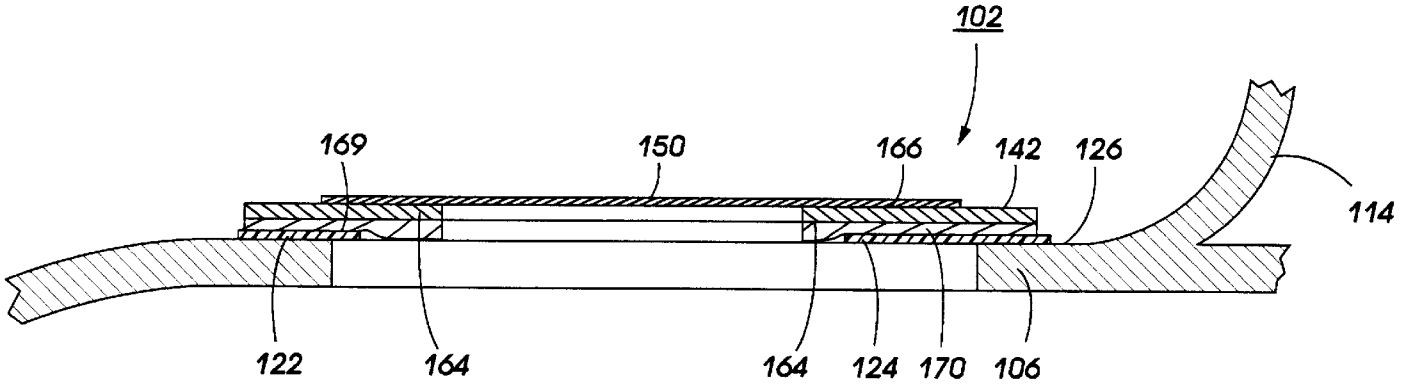
FIG. 3 is a partial plan view along the line 3—3 in the direction of the arrows of the FIG. 1 toner cartridge seal.

Referring now to FIG. 3, the seal assembly 102 is shown initially in position over opening 144 of housing 106. The first original sealing strip 122 and the second original sealing strip 124 are positioned on original sealing surface 126 of housing 106. Adhesive 170 is applied to top surface 169 of the strips 122 and 124. The lower face 164 of body 142 is secured to adhesive 170. The seal 150 is secured to upper face 166 of body 142.

Figure 4:
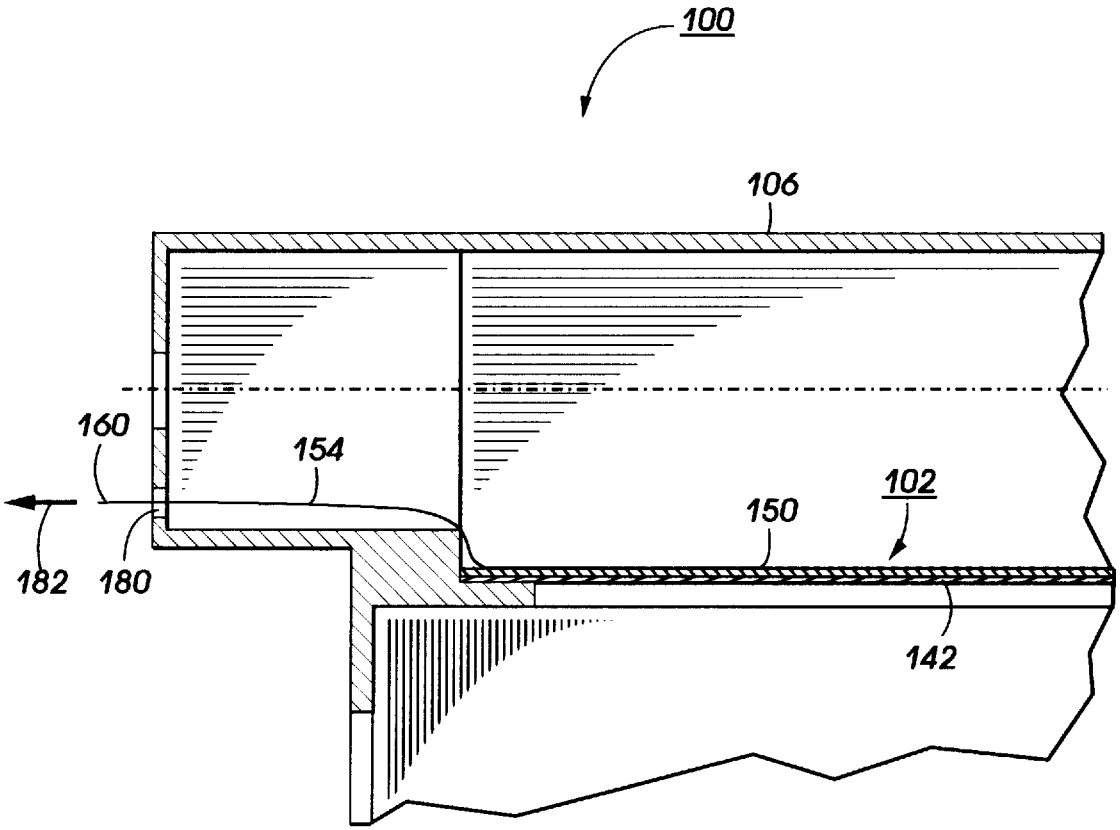
FIG. 4 is a partial plan view along the line 4—4 in the direction of the arrows of the FIG. 1 customer replaceable unit.

Referring now to FIG. 4, the seal assembly 102 is shown installed in housing 106 of CRU 100. The pull strip 154 extends outside housing 106 an end 160 of the. A slit 180 is formed in housing 106 to provide a path for the pull strip 154 to be removed from the CRU 100. The slit 180 has a size and is so positioned to permit the pull strip 154 to be removed from the CRU 100 by pulling in the direction of arrow 182.

Referring now to FIG. 5, the seal assembly 102 is shown installed against original sealing surface 126 at second end portion 136. The body 142 overlays top surface 169 of the first original sealing strip 122 and the second original sealing strip 124. The body 142 also overlays the original sealing surface 126 at second end portion 136. The strips 122 and 124 have a thickness TT of approximately 0.001 to 0.011 inches. The top surface 169 and original sealing surface 126 define the gap 172 there between. At the gap 172, the adhesive 170 must fill the space between the housing 106 and the body 142. It is important that the adhesive has a sufficient thickness and composition to fill the gaps to prevent toner to breakout through the gaps 172.

By providing an adhesive which conforms to the non planar 15 surface, a seal may be provided which may be applied over an existing broken seal.

By providing a seal for a toner cartridge which includes an adhesive which will fill voids between non parallel services, a new seal who may be applied over an existing broken seal.

By providing a seal which prevents leakage of non planar services, a toner cartridge may be remanufactured without removing the old seal.

By providing a seal for a remanufactured toner cartridge which conforms to the uneven surface of a torn seal, the cost and time required to remove an worn seal may be avoided.

By providing an adhesive of proper consistency, which may fill voids between non parallel surfaces, a seal may be applied over a torn seal surface and avoid leakage through the gaps between the non-parallel surfaces.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A seal for use with a refilled toner cartridge for resealing an aperture in communication with a chamber for storing toner, the aperture being defined by a planar recessed wall of a housing of the refilled toner cartridge, the cartridge including remnants of a ruptured closure positioned on the planar recessed wall, the remnants including at least portions of a pair of longitudinal strips of said closure, a first portion of at least one of the strips located between opposed ends of the aperture and a second portion of at least one of the strips extending past opposed ends of the aperture, the seal being positioned on the housing adjacent the aperture, the housing and the longitudinal strips cooperating to define a non-planar surface surrounding the periphery of the aperture, said seal comprising:

a body having an inner periphery thereof defining a opening through said body, said body defining an outer periphery thereof, a portion of which is matingly fittable to the housing, said body having a first surface including a section thereof positionable outside the first portion of at least one of the strips;

a member secured to a second surface of said body, said second surface opposed to said first surface; and an adhesive secured to at least a portion of the first surface of said body, said adhesive extendible between the first surface and the longitudinal strips and between the first surface and the wall such that the strips and the adhesive form a toner retaining seal around the aperture between the wall and the body so as to permit the cartridge to be sealed without removal of the pair of longitudinal strips.

2. A seal according to claim 1:

wherein the remnants of the closure include a pair of longitudinal strips which extend along the length of the aperture and past opposed ends of the aperture; and wherein the adhesive is applied between the first surface of said body and the longitudinal strips adjacent the length of the aperture and between the first surface of said body and the wall at the opposed ends such that the strips and the adhesive form a toner retaining seal around the aperture between the wall and the body.

3. A seal according to claim 2, wherein said body comprises polystyrene.

4. A seal according to claim 1, wherein said member comprises a plastic.

5. A seal according to claim 1, wherein said member comprises a polymer.

6. A seal according to claim 1, wherein said adhesive comprises an acrylic resin.

7. A seal according to claim 1, wherein said adhesive has a thickness of approximately 0.13 to 0.25 millimeters.

8. A seal according to claim 1, wherein said member comprises a portion thereof extending substantially therefrom for permitting the rupture of the seal after said seal is installed into the cartridge.

9. A refilled toner cartridge for use in a printing machine comprising:

a housing defining a chamber therein for storing toner and including a planar recess wall defining an aperture in the housing, the aperture being in communication with the chamber and;

remnants of a ruptured closure positioned on the housing adjacent the aperture, said remnants including at least portions of a pair of longitudinal strips of said closure, a first portion of at least one of the strips located between opposed ends of the aperture and a second portion of at least one of the strips extending past opposed ends of the aperture, the wall and the remnants cooperating to define a non-planar surface adjacent the periphery of the aperture, and a seal for resealing the aperture, said seal including a body having an inner periphery thereof defining a opening through said body, said body defining an outer periphery thereof, a portion of which is matingly fittable to the housing, said body having a first surface including a section thereof positionable outside the first portion of at least one of the strips, a member secured to a second surface of said body, said second surface opposed to said first surface, and an adhesive secured to at least a portion of the first surface of said body, said adhesive extendible between the first surface and the longitudinal strips and between the first surface and the wall such that the strips and the adhesive form a toner retaining seal around the aperture between the wall and the body so as to permit the cartridge to be sealed without removal of said pair of longitudinal strips.

10. A cartridge according to claim 9:

wherein the remnants of the closure include a pair of longitudinal strips which extend along the length of the aperture and past opposed ends of the aperture; and wherein the adhesive is applied between the first surface of said body and the longitudinal strips adjacent the length of the aperture and between the first surface of said body and the wall at the opposed ends such that the strips and the adhesive form a toner retaining seal around the aperture between the wall and the body.

11. A cartridge according to claim 10, wherein said body comprises polystyrene.

12. A cartridge according to claim 9, wherein said member comprises a plastic.

13. A cartridge according to claim 9, wherein said member comprises a polymer.

14. A cartridge according to claim 9, wherein said adhesive comprises an acrylic resin.

15. A cartridge according to claim 9, wherein said adhesive has a thickness of approximately 0.13 to 0.25 millimeters.

16. A cartridge according to claim 9, wherein said member comprises a portion thereof extending substantially therefrom for permitting the rupture of the seal after said seal is installed into the cartridge.

17. A cartridge according to claim 9, wherein said housing comprises a portion thereof spaced from and adjacent the aperture extending normally outwardly therefrom.

18. An electrophotographic printing machine of the type including a refilled toner cartridge, said toner cartridge comprising:

a housing defining a chamber therein for storing toner and including a planar recess wall defining an aperture in the housing, the aperture being in communication with the chamber and;

remnants of a ruptured closure positioned on the housing adjacent the aperture, said remnants including at least portions of a pair of longitudinal strips of said closure, a first portion of at least one of the strips located between opposed ends of the aperture and a second portion of at least one of the strips extending past opposed ends of the aperture, the wall and the remnants cooperating to define a non-planar surface adjacent the periphery of the aperture, and a seal for resealing the aperture, said seal including a body having an inner periphery thereof defining a opening through said body, said body defining an outer periphery thereof, a portion of which is matingly fittable to the housing, said body having a first surface including a section thereof positionable outside the first portion of at least one of the strips, a member secured to a second surface of said body, said second surface opposed to said first surface, and an adhesive secured to at least a portion of the first surface of said body, said adhesive extendible between the first surface and the longitudinal strips and between the first surface and the wall such that the strips and the adhesive form a toner retaining seal around the aperture between the wall and the body so as to permit the cartridge to be sealed without removal of said pair of longitudinal strips.

19. A printing machine according to claim 18:

wherein the remnants of the closure include a pair of longitudinal strips which extend along the length of the aperture and past opposed ends of the aperture; and wherein the adhesive is applied between the first surface of said body and the longitudinal strips adjacent the length of the aperture and between the first surface of said body and the wall at the opposed ends such that the strips and the adhesive form a toner retaining seal around the aperture between the wall and the body.

20. A printing machine according to claim 19, wherein said body comprises polystyrene.

21. A printing machine according to claim 18, wherein said member comprises a plastic.

22. A printing machine according to claim 18, wherein said member comprises a polymer.

23. A printing machine according to claim 18, wherein said adhesive comprises an acrylic resin.

24. A printing machine according to claim 18, wherein said adhesive has a thickness of approximately 0.13 to 0.25 millimeters.

25. A printing machine according to claim 18, wherein said member comprises a portion thereof extending substantially therefrom for permitting the rupture of the seal after said seal is installed into the cartridge.

26. A printing machine according to claim 18, wherein said housing comprises a portion thereof spaced from and adjacent the aperture extending normally outwardly therefrom.

* * * * *